US006851586B2

(12) United States Patent
Odet

(10) Patent No.: US 6,851,586 B2
(45) Date of Patent: Feb. 8, 2005

(54) CLOSURE DEVICE AND CONTAINER PROVIDED WITH SAME

(75) Inventor: Philippe Odet, Saint-Georges-de-Reneins (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 134 days.

(21) Appl. No.: 10/181,065

(22) PCT Filed: Jan. 23, 2001

(86) PCT No.: PCT/FR01/00215

§ 371 (c)(1),
(2), (4) Date: Sep. 26, 2002

(87) PCT Pub. No.: WO01/55003

PCT Pub. Date: Aug. 2, 2001

(65) Prior Publication Data

US 2003/0089746 A1 May 15, 2003

(30) Foreign Application Priority Data

Jan. 25, 2000 (FR) ..... 00 00936

(51) Int. Cl.[7] ..... B65D 47/10
(52) U.S. Cl. ..... 222/541.9; 222/556; 215/235
(58) Field of Search ..... 222/541.9, 556; 215/235, 237; 220/833–835

(56) References Cited

U.S. PATENT DOCUMENTS

| | | | | | |
|---|---|---|---|---|---|
| 2,894,654 | A | * | 7/1959 | Hardy | 215/235 |
| 3,109,547 | A | * | 11/1963 | Wood | 215/256 |
| 4,550,862 | A | | 11/1985 | Barker et al. | |
| 5,785,209 | A | * | 7/1998 | Guglielmini | 222/541.9 |
| 5,875,942 | A | * | 3/1999 | Ohmi et al. | 222/556 |
| 6,283,317 | B1 | * | 9/2001 | Benoit-gonin et al. | 222/556 |

FOREIGN PATENT DOCUMENTS

| | | |
|---|---|---|
| DE | 1532390 | 2/1970 |
| FR | 1406289 | 11/1965 |
| FR | 2113896 | 6/1972 |
| FR | 2749565 | 12/1997 |

* cited by examiner

*Primary Examiner*—Philippe Derakshani
(74) *Attorney, Agent, or Firm*—Dowell & Dowell, P.C.

(57) ABSTRACT

A closure divice for a container including a pourer designed to be fixed on a neck of the container wherein the closure device includes a cover assembly adapted to be mounted on the neck and over the pourer. The cover assembly includes a cap movable between a first position wherein it closes the neck and the pourer from the outside and a second position where it allows access to the neck and to the pourer. The pourer is arranged at least partly inside the neck. The cap is provided with a skirt extending, in the first position of the cap, inside the neck. The skirt has at least one flange capable, when the cap is in the first position, of exerting a force urging the pourer against an edge of the neck.

17 Claims, 5 Drawing Sheets

CLOSURE DEVICE AND CONTAINER PROVIDED WITH SAME

BACKGROUND OF THE INVENTION

1. Field of the Invention

The invention relates to a device for closing a container and to a container equipped with such a device.

2. Brief Description of the Related Art

It is known to make containers for liquid, such as milk bottles made of plastics material, for example high density polyethylene. It is essential that such containers be hermetically closed particularly with a view to their transport from the point of sale to the place of use. To that end, it may be provided to seal the neck of a bottle with a membrane based on aluminum. However, in practice, it proves delicate to remove such a membrane and it is not rare for pieces of this membrane to remain in place on the neck, this rendering use of the container delicate and raising problems during its reprocessing for valorisation, as the residues of aluminum must be treated differently from the body of plastics material. In addition, the known containers tend to leak after the aluminum-based membrane has been removed, i.e. after first use of the fluid that they contain.

Attempts have been made to produce systems for closing bottles without a membrane, particularly by means of screwed stoppers. However, as bottles are most often made by blowing a parison and/or extrusion, relatively great manufacturing tolerances appear at their neck while irregularities cannot always be eliminated at the plan of the juncture in the mold. Such variations in dimensions induce risks of leakage which are not acceptable in practice.

The problems set forth hereinabove are also raised for bottles equipped with a pourer intended to promote flow of a liquid.

Furthermore, it is known from DE-A-1 532 390 to provide a cylindrical skirt on the inner surface of the bottom of a stopper, this skirt being supposed to undergo a centripetal force exerted by a pourer. The tightness obtained with this device cannot be guaranteed, particularly due to the fact that the skirt of the stopper is not rigid but, on the contrary, provided to be deformed.

SUMMARY OF THE INVENTION

It is a particular object of the invention to overcome these drawbacks by proposing a closure device not presenting an aluminum membrane and allowing a container to be hermetically closed before and after the first use of the fluid that it contains.

In this spirit, the invention relates to a container provided with a neck and equipped with a closure device comprising a pourer designed to be permanently fixed on this neck, and a cap adapted to be mounted on this neck and/or this pourer, being mobile between a first position wherein it isolates the neck and the pourer from the outside and a second position where it allows access to this neck and to this pourer, the pourer being arranged at least partly inside the neck. The cap is provided with a skirt extending, in the afore-mentioned first position and from an inner surface of the cap, up to inside the neck. This device is characterized in that this skirt bears at least an outer flange arranged so that it exerts, in the afore-mentioned first position and against an inner radial surface of the pourer, a force which is centrifugal with respect to an axis of symmetry and urging this pourer against an inside end edge of the neck.

The skirt of the invention compresses the pourer against the neck of the container, which makes it possible to ensure tightness, on the one hand, between the pourer and the neck and, on the other hand, between the skirt and the pourer. The tightness between the pourer and the neck is necessary for the whole life of the container while the tightness between the cap and the pourer is useful as soon as a membrane possibly obturating the pourer has been removed, i.e. after first use of the fluid contained in the container. The concentration of force obtained thanks to the flange allows a localised and firm abutment of the pourer against the inner edge of the neck.

According to advantageous but non-obligatory aspects of the invention, the device incorporates one or more of the following characteristics:

- The afore-mentioned edge and skirt are substantially cylindrical, while the force exerted by the skirt on the pourer is centrifugal with respect to an axis of symmetry of the afore-mentioned edge.
- In the first position, the flange is arranged opposite the edge of the neck, the force exerted by the flange tending to compress a part of the pourer against this edge. Such compression of the pourer takes advantage of its deformable nature and ensures the desired tightness.
- The skirt is equipped with two outer flanges bearing against the inner radial surface of the pourer, the second flange being provided to ensure clipping between the cap and the pourer after the first use of the container. The nominal outer diameter of the flange or flanges may also be provided to be greater than or equal to the diameter of the inner radial surface of the pourer at the level of the afore-mentioned edge. This guarantees that the skirt of the cap tends to expand the pourer radially as soon as it is positioned inside the pourer, such expansion being produced preferentially at the level of the edge of the neck, which makes it possible to compress the pourer efficiently between the flange and the neck.
- The skirt is formed in one piece with the cap, in a material which is harder than the material of the pourer. The one-piece nature of the cap and of the skirt gives them a satisfactory solidity and rigidity while the fact that the material constituting the skirt is harder than that of the pourer, makes it possible to privilege a deformation of the pourer when the skirt bears against the pourer.
- The neck, the pourer and the cap are made of plastics material. In that case, the neck and the cap may be provided to be made of high or medium density polyethylene, while the pourer is made of low density polyethylene.

The invention also relates to a container for liquid, particularly a plastic bottle equipped with a closure device as described hereinabove. Such a container can be transported without risk of leakages before and after the first use of the fluid that it contains, and may easily be recycled as it does not comprise an aluminum based membrane. The edge of the neck is advantageously sheathed by the inner end of a substantially truncated zone of the neck.

BRIEF DESCRIPTION OF THE DRAWINGS

The invention will be more readily understood and other advantages thereof will appear more clearly in the light of the following description of a form of embodiment of a closure device according to the invention, given solely by way of example and made with reference to the accompanying drawings, in which.

DESCRIPTION OF THE PREFERRED EMBODIMENT

Figure 1:
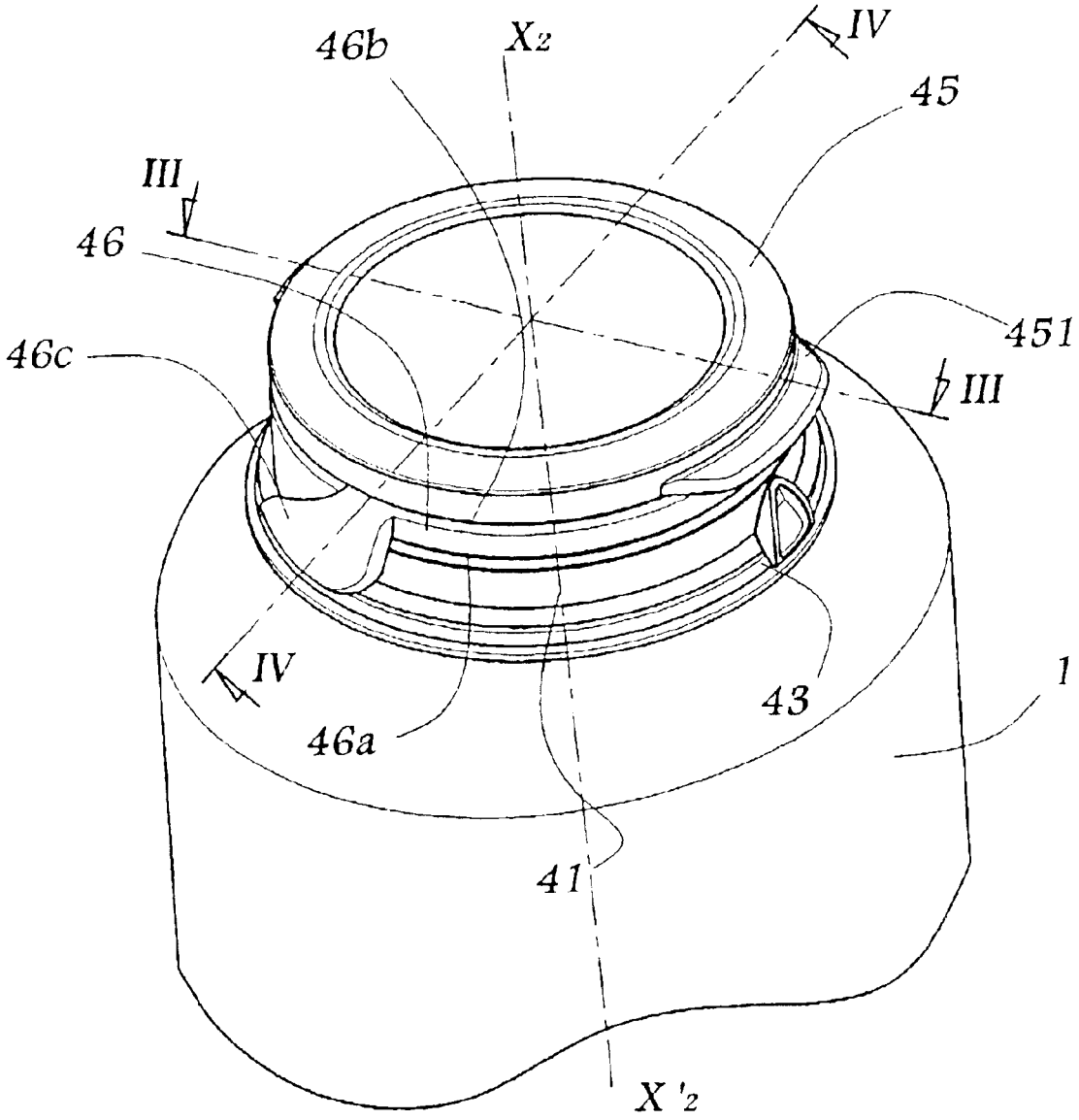
FIG. 1 is a view in perspective of an upper part of a milk bottle according to the invention, equipped with a closure device in accordance with its principle, of which the cap is in a first position.

The bottle shown in the Figures is a bottle intended to contain milk, made by blowing a parison of high density polyethylene. The cost of such a bottle is attractive, while it performs its function of a container efficiently.

The neck 2 of this bottle is cylindrical and $X_2$–$X'_2$ denotes its axis of symmetry. This neck has a curved generatrix and it defines a substantially truncated zone 21 of which the inner end forms the edge 22 of the neck 2, the zone 21 extending by a first flange 23 extending radially towards the outside with respect to the axis $X_2$–$X'_2$. A section 24 joins the flange 23 to a second flange 25, itself joined by a second section 26 to the principal body 11 of the body 1.

The closure device comprises a pourer 3 and an assembly 4 forming cover made of plastics material. The pourer 3 is molded from low density polyethylene while the assembly 4, which is in one piece, is molded from high or medium density polyethylene. The assembly 4 is therefore made of a material more rigid than that of the pourer 3. Other materials may be used for molding the elements 2, 3 and 4, the material of the pourer remaining less rigid than those of the neck 2 and of the assembly 4.

The pourer 3 is cylindrical and symmetrical about an axis $X_3$–$X'_3$ merged with axis $X_2$–$X'_2$ when the pourer 3 is mounted on the neck 2. The pourer 3 comprises a part 31 with substantially rectilinear generatrix of which the edge 32 opposite the body 11 of the bottle 1 is curved outwardly, with the result that it forms a surface 32*e* for flow of the milk without contact with the neck 2. The part 31 is partially arranged inside the neck 2.

From a median zone of the part 31 there extends radially towards the outside of skirt 33 intended to cover the zone 21 and the flange 23 of the neck 2, the skirt 33 being provided, at its edge 34 distant from the part 31, with a catching beard 35, intended to mesh against a radial surface 23*a* of the flange 23 opposite the part 21. This allows an immobilization by cooperation of shapes of the pourer 3 of the neck 2.

The bead 35 presents an inner face 35*a* divergent in the direction of the body 11, with the result that the pourer 3 can be positioned on the neck 2 by elastic clipping by means of an elastic deformation of the skirt 33 when the pourer 3 is pushed on the neck 2 in the direction of the body 11.

A membrane 36 is connected to the part 31 by a zone 36*a* of rupture, this membrane making it possible to isolate the interior volume of the bottle 1 as long as it remains in place. The membrane 36 is secured to a grip ring 37 in which a user can pass a finger to exert a force $F_1$ directed opposite the body 11 in order to remove this membrane when the milk contained in the bottle is used.

The assembly 4 comprises a ring 41 intended to be disposed around the neck 2, the ring 41 being provided with a catching bead 42 adapted to come into mesh against a lower surface 23*a* of the flange 25. Lower is understood to mean that the surface 25*a* is oriented downwardly when the bottle 1 is placed on a flat surface, its neck facing upwardly.

The ring 41 also contributes to maintaining the skirt 33 in mesh with the flange 23 in position. The ring 41 extends in the direction of the body of the bottle 1 by a ring 43 making it possible to mask the transition part between the neck 2 and the body and the bottle 1.

The inner face 42*a* of the bead 42 is also truncated and divergent in the direction of the body 11, which makes it possible to envisage an elastic clipping of the ring 41 on the neck 2.

The ring 41 is joined by a hinge 44, formed by an elastically deformable thinned zone, to a substantially cylindrical cap 45 of which $X_{45}$–$X'_{45}$ denotes the central axis. Before the first use of the bottle 1, the cap is joined by a band 46 to the ring 41 over virtually the whole of the circumference of this ring, axes $X_2$–$X'_2$ and $X_{45}$–$X'_{45}$ being merged. The band 46 is respectively joined by two frangible zones 46*a* and 46*b* to the ring 41 and to the cap 45. A tongue 46*c* makes it possible to remove the ring 46 by rupture of the zones 46*a* and 46*b*, which allows a movement of pivoting of the cap 45 around axis $X_{44}$–$X'_{44}$ of the hinge 44 between the positions of FIGS. 1 and 2.

Figure 2:
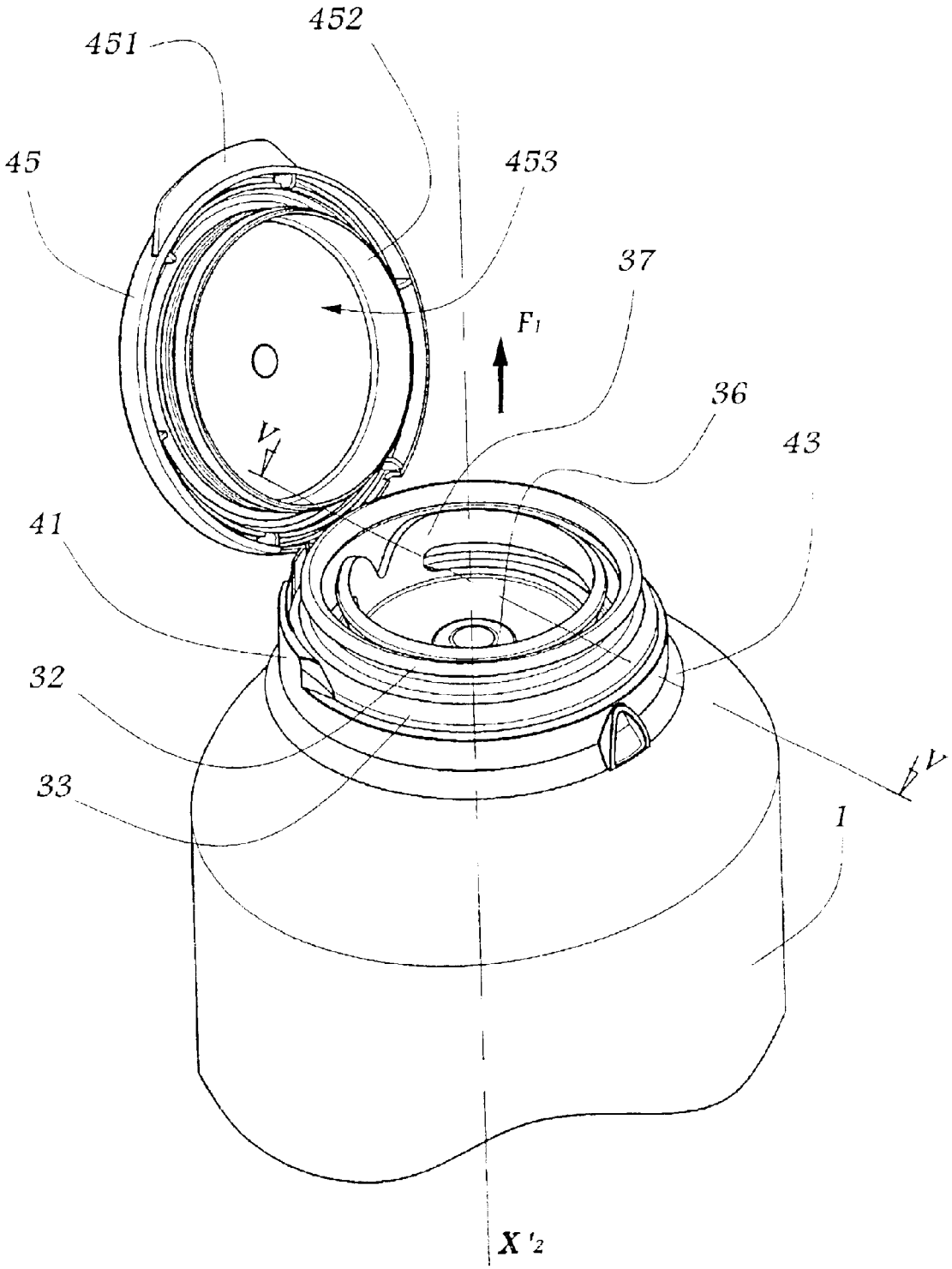
FIG. 2 is a view in perspective similar to FIG. 1, while the cap is in a second position.

The hinge 44 may be associated with bistable tongues, which makes it possible to conserve the orientation of the cap 45 in each of the positions shown in FIGS. 1 and 2.

Figure 3:
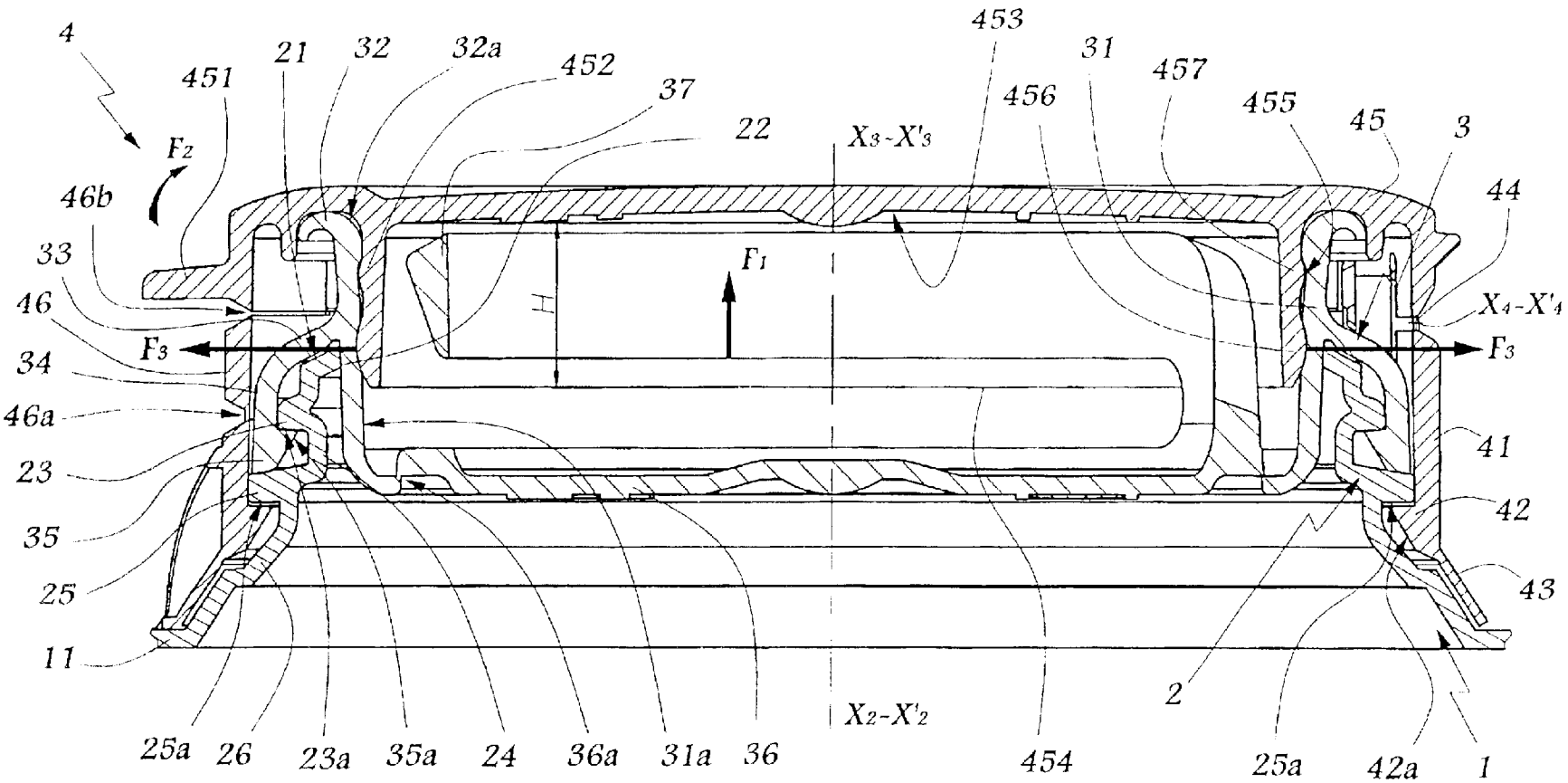
FIG. 3 is a section along line III—III in FIG. 1.
Figure 5:
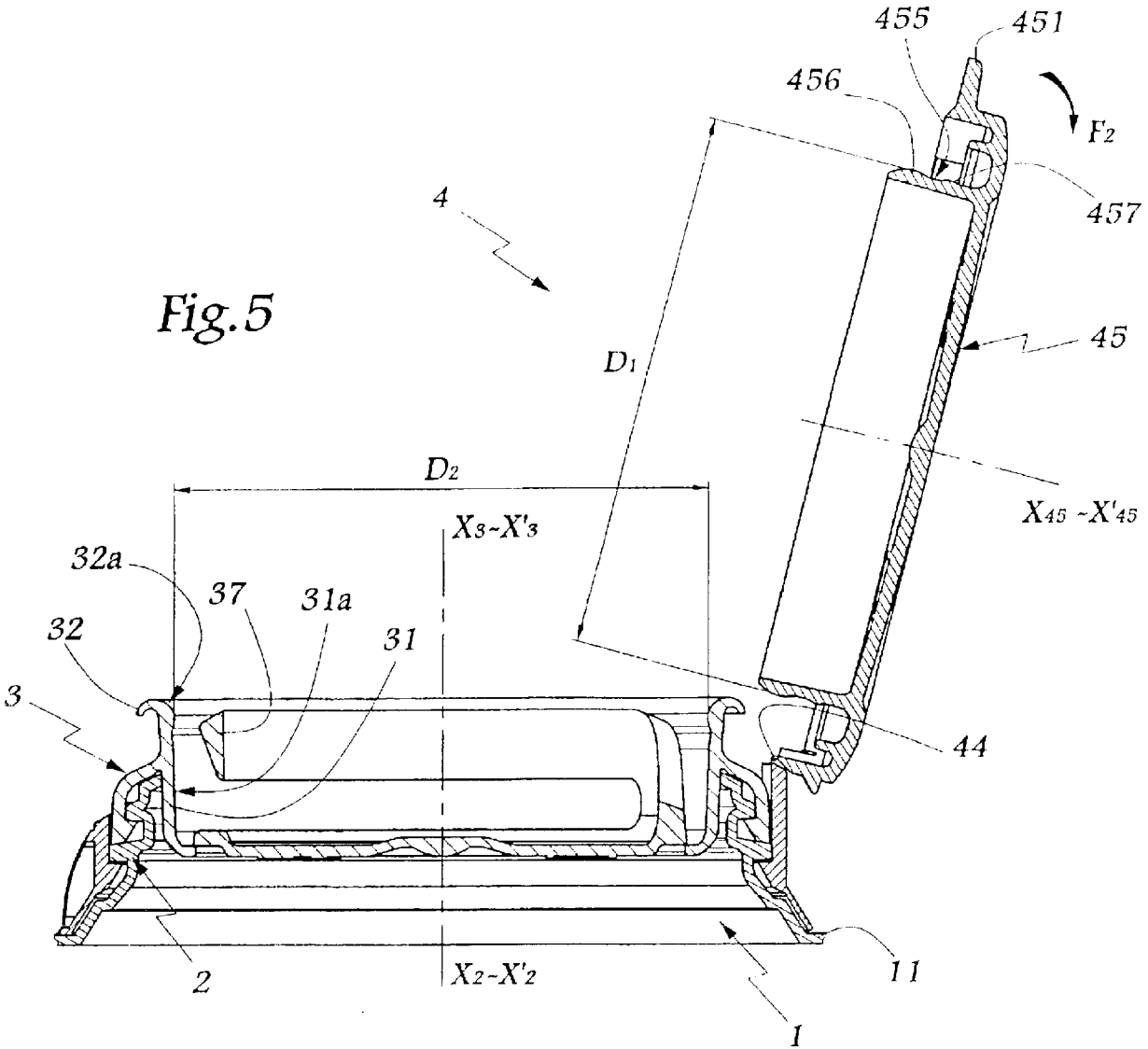
FIG. 5 is a section on a smaller scale along line V—V in FIG. 2.

The cap 45 is equipped with a tongue or "peaked cap" 451 allowing it to be lifted by a force $F_2$ represented in FIGS. 3 and 5.

According to the invention, the cap 45 is equipped with a skirt 452 which is cylindrical and centered on axis $X_{45}$–$X'_{45}$.

Figure 4:
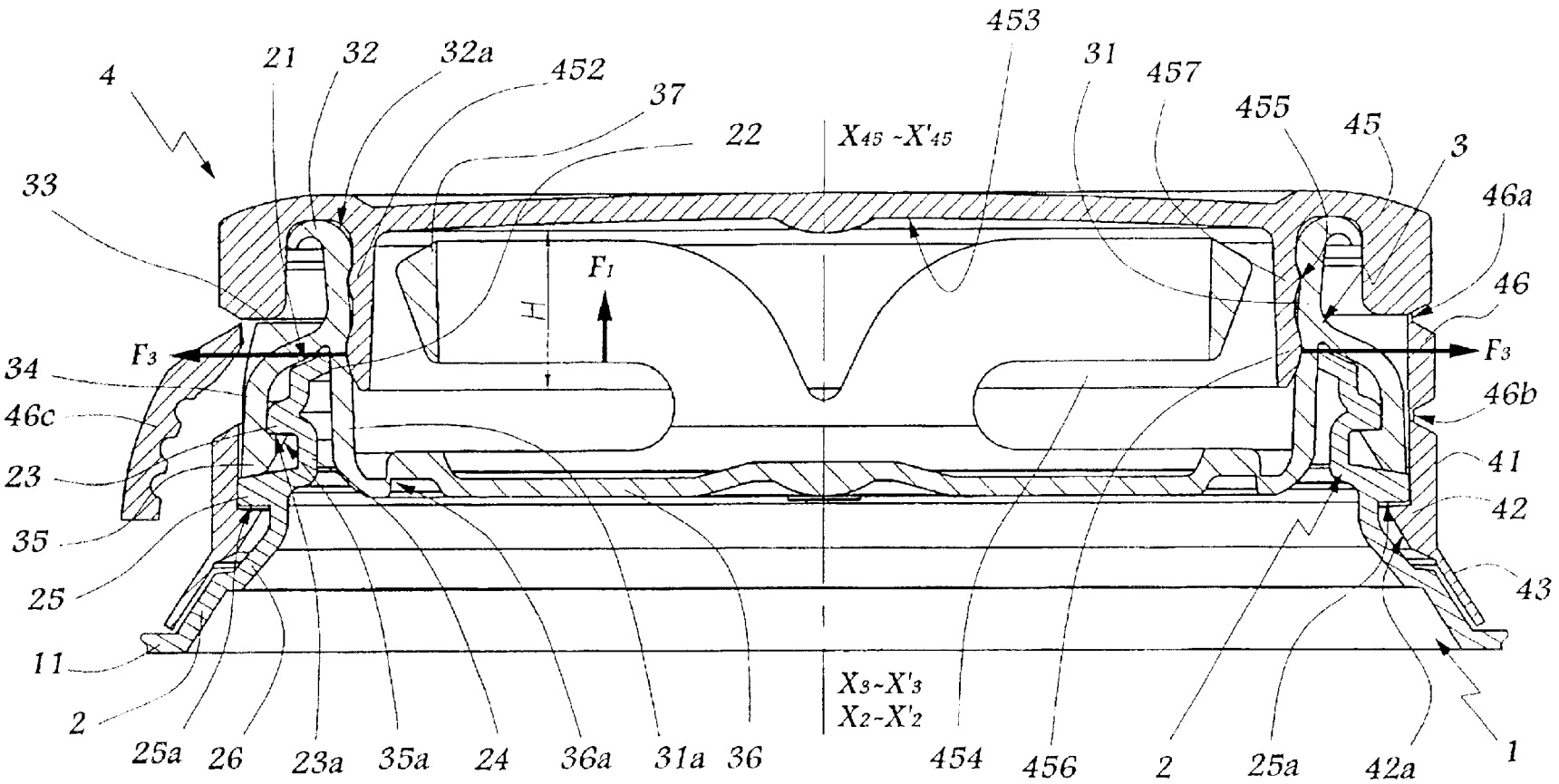
FIG. 4 is a section along line IV—IV in FIG. 1.

The skirt 452 extends in the direction of the interior volume of the bottle 1 from the inner surface 453 of the cap 45 which is oriented towards this interior volume. The height H of the skirt 452 measured parallel to axis $X_{45}$–$X'_{45}$ is such that, in the closed position shown in FIGS. 1, 3 and 4, the lower edge 454 of the skirt 452 is located below the edge 22 of the neck 2, i.e. towards the interior volume of the bottle 1.

The outer radial surface 455 of the skirt 452 is provided with two flanges, referenced 456 and 457 respectively, which extend radially towards the outside with respect to the surface 455. The flange 456 is arranged in the vicinity of the edge 454, with the result that it is located at the level of the edge 22 when the cap 45 is in closed configuration and that it is adapted to exert on the inner radial surface 31*a* of the part 31 a force $F_3$ centrifugal with respect to axes $X_3$–$X'_3$ and $X_{45}$–$X'_{45}$ which in that case merge, this force $F_3$ tending to compress this part 31 against the edge 22.

Such compression is possible due to the difference in hardness between the skirt 452 and the edge 22 of the neck 2, on the one hand, and that part 31 of the pourer 3, on the other hand, which is more supple or "softer" than the elements 452 and 22 between which it is compressed.

The force $F_3$ therefore makes it possible to guarantee the tightness on the one hand between the pourer 3 and the neck 2, i.e. between the part 31 and the edge 22 and, on the other hand, between the pourer 3 and the assembly forming cover 4, i.e. between the flange 456 and the part 31.

The flange 456 makes it possible to concentrate the force exerted on the part 31 of the pourer 3 at the level of the edge 22, this further improving the tightness obtained.

The outer diameter $D_1$ of the flange 456 is chosen to be slightly larger than the inner diameter $D_2$ of the surface 31*a* at the level of the edge 22, with the result that, by simply positioning the skirt 452 inside the pourer 3, a force $F_3$ of sufficient intensity is obtained. In practice, satisfactory results can be obtained with a difference between the diameters $D_1$ and $D_2$ included between 0.5 and 1 mm, while these diameters are included between 20 and 40 mm, preferably of the order of 30 mm.

The pourer 3, on the one hand, and the assembly 4 forming cap, on the other hand, are each made in one piece by molding, with the result that they are easy to manipulate and position on the neck 2. In particular, the fact that the skirt 452 is in one piece with the cap 45 gives it a good rigidity while its cost price is particularly attractive.

The invention has been described with an assembly forming a hinged cap. However, it is applicable with a screwed cap.

What is claimed is:

1. Container (1) provided with a neck (2) and equipped with a closure device, the container comprising a pourer (3) secured on said neck, and a cover assembly (4) mounted on said neck and over said pourer and including a cap (45) movable between a first position wherein it covers said neck and said pourer from the outside and a second position where it allows access to said pourer, said pourer being arranged at least partly inside an opening into said neck, said cap being provided with a skirt (452) extending, in said first position and from an inner surface (453) of said cap, inside said neck, said skirt (452) including at least one outer flange (456) arranged so that it exerts, in said first position of said cap, a force ($F_3$) against an inner radial surface (31*a*) of said pourer which force is centrifugal with respect to an axis ($X_3$–$X'_3$) of symmetry of said pourer and which forces urges said pourer against an end edge (22) of said neck (2).

2. Container according to claim 1 wherein said edge (22) and said skirt (452) are substantially cylindrical and in that said force ($F_3$) is centrifugal with respect to an axis ($X_2$–$X'_2$) of symmetry of said edge.

3. Container according to claim 1, wherein in said first position of said cap said at least one flange (456) is arranged opposite said edge (22), said force ($F_3$) compressing a part (31) of said pourer (3) against said edge.

4. Container according to claim 3 wherein said skirt (452) is equipped with a second outer flange (457) which bears against said inner radial surface (31*a*) of said part (31) of said pourer (3) when said cap is in said first position to thereby apply additional force against said pourer.

5. Container according to claim 4, wherein a nominal outer diameter ($D_1$) of said flanges (456, 457) is greater than or equal to a diameter ($D_2$) of said inner radial surface (31*a*) of said pourer (3) adjacent said edge (22).

6. Container according to claim 5, wherein said skirt (452) is formed in one piece with said cap (45) of a material which is harder than a material from which said pourer is made.

7. Container according to claim 1, wherein said neck (2), said pourer (3) and said cover assembly (4) are made of plastic materials.

8. Container according to claim 7 wherein said neck (2) and said cover assembly (4) are made of high or medium density polyethylene and said pourer (3) is made of low density polyethylene.

9. Container according to claim 1 wherein said container is a bottle made of plastic material.

10. Container according to claim 1 wherein said edge (22) of said neck (2) is formed by an inner end of a substantially truncated zone (21) of said neck.

11. Container according to claim 1, wherein a nominal outer diameter ($D_1$) of said at least one flange (456) is greater than or equal to a diameter ($D_2$) of an inner radial surface (31*a*) of said pourer (3) adjacent to said edge (22).

12. Container according to claim 11 wherein said skirt (452) is formed in one piece with said cap (45) of a material which is harder than a material from which said pourer is formed.

13. Container according to claim 12 wherein said neck (2) and said cover assembly (4) are made of high or medium density polyethylene and said pourer (3) is made of low density polyethylene.

14. Container according to claim 13, wherein said container is a bottle made of plastic material.

15. Container according to claim 12 wherein said edge (22) of said neck (2) is formed by an inner end of a substantially truncated zone (21) of said neck.

16. Container according to claim 13 wherein said skirt (452) is equipped with a second outer flange (457) for bearing against said inner radial surface (31*a*) of said pourer (3).

17. Container according to claim 13, wherein, in said first position of said cap, said at least one flange (456) is arranged opposite said edge (22), said force ($F_3$) compressing said pourer (3) against said edge.

* * * * *